United States Patent [19]

Somosi et al.

[11] 4,012,298

[45] Mar. 15, 1977

[54] PROCESS FOR THE ELECTROLYTIC RECOVERY OF GALLIUM AND/OR ALKALI METALS

[75] Inventors: István Somosi; Béla Tóth; József Boros; János Vitéz, all of Ajka, Hungary

[73] Assignee: Ajkai Timfoldgyar es Aluminiumkoho, Ajka, Hungary

[22] Filed: Sept. 12, 1975

[21] Appl. No.: 612,803

[30] Foreign Application Priority Data

May 21, 1975 Hungary ..... AA 814

[52] U.S. Cl. ..... 204/105 R; 204/38 B; 204/125

[51] Int. Cl.[2] ..... C25C 1/22

[58] Field of Search ... 204/105 R, 290 R, 291–292, 204/125, 38 B

[56] References Cited

UNITED STATES PATENTS

| | | | |
|---|---|---|---|
| 2,793,179 | 5/1957 | La Breteque | 204/105 R |
| 3,677,918 | 7/1922 | Miyake | 204/105 R |
| 3,785,949 | 1/1974 | Matthey et al. | 204/219 |

OTHER PUBLICATIONS

"Electromotive Series".

*Primary Examiner*—R. L. Andrews
*Attorney, Agent, or Firm*—Karl F. Ross; Herbert Dubno

[57] ABSTRACT

A method of electrolytically recovering gallium and/or alkali metals from alkali metal solutions, preferably aluminate (sodium aluminate) liquors from aluminate production in which the gallium or alkali metal is electrolytically deposited on a mercury layer of the thickness of several microns applied to a metallic support which is more electronegative than mercury (preferably copper) by amalgamation or cementation from a mercury salt solution. The deposition of metals is carried out at a temperature below 50° C and the cathode is then treated with a solvent, e.g. mercury or water, to remove the deposited elements.

8 Claims, No Drawings

PROCESS FOR THE ELECTROLYTIC RECOVERY OF GALLIUM AND/OR ALKALI METALS

FIELD OF THE INVENTION

The invention relates to a process for the electrolytic recovery of gallium and/or alkali metals from alkali-metal solution, especially the aluminate liquors generated by crystalline aluminate production.

BACKGROUND OF THE INVENTION

In the production of aluminates, there are formed aluminate liquors which, in spite of the relatively low gallium concentration (0.2 to 0.3 grams per liter), have proved to be suitable sources for the industrial production of gallium.

The recovery of gallium can take place by a number of conventional processes. Most of the electrolytic techniques involve the deposition of gallium on mercury cathodes. The mercury or sodium amalgam cathodes which are used for this purpose have the advantage, over solid metal cathodes of a single metal, that they have a high hydrogen overvoltage so that gallium deposits with high efficiency.

Of course, in spite of the aforementioned advantages, the use of mercury cathodes had had limited applicability because of the health and environmental hazards which are produced when the mercury is released into the environment as is common with the conventional techniques.

In alkali media, thus in aluminate liquors, the electrode deposition potential of gallium is more negative than −1.6 volts. With solid metal cathodes this electrode potential cannot be maintained or can be maintained only fleetingly. The potential of the cathode during electrolysis changes as a result of the deposition of electropositive impurities from the aluminate liquor and as a result of the shielding effect of reducing organic substances these effects tending to make the cathode more positive. Within increasingly positive potentials, the deposition of gallium does not take place to completeness since the cathode operates as a hydrogen generating electrode. In practice it is found that gallium does not deposit on solid metal electrodes because of this interplay of effects.

OBJECTS OF THE INVENTION

It is the object of the present invention to provide a process in which gallium and/or alkali metal can be deposited on a surface of a solid metal cathode whereby the process operates with the greater efficiency of a mercury or amalgam cathode, but the formation of dispersed mercury and mercury oxides is reduced and the need for recovering of these toxic substances and the purification of the electrolyte is avoided or reduced.

DESCRIPTION OF THE INVENTION

This object and others which will become apparent hereinafter are attained in accordance with the present invention by a process for the recovering of gallium and/or alkali metals from alkali metal solutions (aqueous) containing same and especially from the aluminate liquors produced by the production of crystalline aluminates, which comprises electrodepositing the gallium and/or the alkali metals on a mercury layer applied in a thickness of several microns to the surface of a metal more electronegative than mercury (preferably a copper surface) as an amalgam or by cementation from mercury solution, the deposition of gallium or the alkali metal being carried out at a temperature below 50° C.

According to the invention, the deposition of gallium and/or the alkali metal is followed, discontinuously or continuously, by dipping the cathode in mercury or, in the case of alkali metals, by treating the cathode with water and in the case of gallium solubilizing the gallium in alkali or acid solution. This latter step thus involves the treatment of the cathode with a solvent for the electrolytically deposited element.

The invention is based upon the following considerations.

When a mercury layer in the form of cemented mercury or a mercury amalgam is applied to a metal surface which is more electronegative than mercury, e.g. a copper surface, the mercury thus formed prevents further autosolubilization of copper and results in a unitary, coherent, mechanically stable and chemically resistance mercury layer capable of withstanding acids and alkalis and functioning during electrolysis as a mercury or amalgam cathode. This is the effect when the mercury is applied to the copper surface from a mercury solution, the mercury deposition reaction terminating once the mercury containing coating completely covers the copper.

The deposition of gallium from the aluminate liquors of aluminate production processes upon the mercury cathode upon the copper carrier electrode is not only a consequence of cementation but is also a consequence of electrolysis since the application of direct current deposits sodium whose cementation effect reduces gallium and enables the sodium to maintain the low (negative) electrode potential by which electrolytic deposition of gallium is promoted.

The gallium deposited by cementation and electrolysis on the mercury cathode deposited on the carrier electrode is so retained that any hydrogen generated during the electrolysis does not release the gallium or mercury.

Thus, as compared with conventional processes using mercury cathodes, the present system has the advantage that hazards from the release of mercury are practically excluded. Since the loss of mercury is negligible or nonexistent any increase in the operating costs of the process by the need to form the mercury coated electrode is more than compensated by decreased consumption of mercury.

According to the invention, the carrier electrode is introduced into an electrolysis cell containing a mercury salt solution from which mercury deposits by cementation from the copper. Alternatively, the copper electrodes can be introduced into the cell into which is also introduced sodium hydroxide solution and mercury so that electrolysis forms an amalgam upon the carrier metal.

Upon removal of the solutions from the cell the amalgam-coated or mercury coated electrode remains therein and an anode is introduced. The alkali metal solution, preferably the aluminate liquor, is then passed continuously through the cell while electrolysis is undertaken.

The residence time for the contact between the electrolyte and the mercury cathode deposited on the carrier is, of course, determined by the characteristics of the electrolyte and the ability of the cathode to take up gallium, considering that the mercury contains 0.5 to 1.0% by weight sodium. When the mercury cathode is saturated, of course, the presence of gallium shielding the cathode against further acceptance of gallium, removal of gallium should be carried out.

The residence time can vary between several hours and several days.

For removal of the deposited alkali metal and/or gallium, the mercury cathode (on the carrier electrode) is immersed in mercury or washed with water. The immersion in mercury results in almost total solubilization of gallium in the mercury bath while the washing of the mercury cathode with water results in solubilization of the alkali metal, whereupon gallium can be removed by solubilization with alkali (sodium hydroxide solution) or acid (e.g. nitric acid). This solubilization treatment simultaneously regenerates the cathode and renders it amenable to deposit of further quantities of further alkali metal or gallium.

The solubilization of the metal to be recovered can be carried out continuously or discontinuously. For discontinuous solubilization, the cells may be filled alternately with electrolyte and the solubilizing medium (solvent) or several cells can be operated in cascade with the electrolyte or the solubilizing media. The recovery of the desired metal from the solubilizing medium can be carried out in any convention way.

SPECIFIC EXAMPLE 5 grams of $Hg(NO_3)_2$ dissolved in 100 milliliters of one normal nitric acid is introduced into an electrolytic cell so that it covers a copper carrier electrode. By autoprecipitation, mercury deposits upon the copper surface and in ten minutes forms a uniform continuous layer. The mercury nitrate solution is then removed from the cell and the cell is rinsed with water.

A nickel anode is introduced into the cell and a gallium-containing aluminate liquor is passed through the cell while an electrolysis current is supplied. The current then sitting at the mercury-copper cathode is 80 amperes per $m^2$ and a maximum temperature of 50° C. Gallium deposits at a rate of 10 to 15 grams per $meter^2$ per day. The gallium is removed by treating the cathode with sodium hydroxide of a concentration of 50 grams per liter at a temperature of 80° C. When the ratio of gallium to sodium hydroxide ($Ga:Na_2O$) reaches 1:1, the gallium is recovered from the solubilizing medium.

We claim:

1. A process for the electrolytic recovery of gallium from an aluminate liquor of the production of crystalline alumina and containing sodium as well as gallium, the process comprising the steps of:

a. applying a mercury layer to a surface of a carrier electrode of a metal more electronegative than mercury until mercury coats said surface to form a mercury cathode;

b. electrolyzing said aluminate liquor at a temperature of less than 50° C with said mercury cathode to initially deposit sodium upon said mercury cathode and then depositing gallium thereon; and c. solubilizing the gallium from said mercury cathode by treating the same with a gallium-solubilizing medium, thereby regenerating said mercury cathode for reuse of the same in step (a) for further acceptance of said recoverable metal.

2. The process defined in claim 1 wherein said carrier electrode is composed of copper.

3. The process defined in claim 2 wherein said recoverable metal is solubilized from said cathode in step (c) by treating said cathode with water to remove recoverable metal consisting of alkali metal and thereafter treating said cathode with a solvent for gallium.

4. The process defined in claim 3 wherein said solvent for gallium is an alkali solution.

5. The process defined in claim 3 wherein said solvent for gallium is an acid.

6. The process defined in claim 2 wherein mercury is deposited on the surface of said carrier electrode by cementation from a mercury salt solution.

7. The process defined in claim 2 wherein mercury is deposited on said carrier electrode as an amalgam.

8. The process defined in claim 2 wherein the recoverable metal is solubilized from said cathode in step (c) by immersing said cathode in mercury.

* * * * *